US008879743B1

(12) United States Patent
Mitra

(10) Patent No.: US 8,879,743 B1
(45) Date of Patent: Nov. 4, 2014

(54) EAR MODELS WITH MICROPHONES FOR PSYCHOACOUSTIC IMAGERY

(76) Inventor: Soumya Mitra, Fremont, CA (US)

( * ) Notice: Subject to any disclaimer, the term of this patent is extended or adjusted under 35 U.S.C. 154(b) by 301 days.

(21) Appl. No.: 13/309,012

(22) Filed: Dec. 1, 2011

Related U.S. Application Data

(60) Provisional application No. 61/425,674, filed on Dec. 21, 2010.

(51) Int. Cl.
*H04R 5/00* (2006.01)

(52) U.S. Cl.
USPC ..... 381/26; 381/365; 181/129

(58) Field of Classification Search
USPC ..... 381/365, 26; 181/133, 129
See application file for complete search history.

(56) References Cited

U.S. PATENT DOCUMENTS 4,088,849 A 5/1978 Usami et al.
4,308,426 A 12/1981 Kikuchi
4,680,856 A * 7/1987 Zuccarelli ..... 29/594
4,910,795 A * 3/1990 McCowen et al. ..... 455/95
5,073,936 A * 12/1991 Gorike et al. ..... 381/26
7,715,568 B2 5/2010 Nakano
2008/0002948 A1 1/2008 Murata et al.
2008/0165996 A1* 7/2008 Saito et al. ..... 381/322
2008/0166048 A1* 7/2008 Raif et al. ..... 382/187
2009/0022343 A1 1/2009 Van Schaak et al.
2010/0104118 A1 4/2010 Sasidharan et al.

* cited by examiner

*Primary Examiner* — Ahmad Matar
*Assistant Examiner* — Katherine Faley
(74) *Attorney, Agent, or Firm* — Larry D. Johnson

(57) ABSTRACT

A compact portable stereo microphone apparatus can acquire three dimensional immersive sounds which can then be recorded and played back in a standard audio recording device. The apparatus includes two elastomer fabricated simplified human ear elements (ear models) fitted at the ends of a cylindrical cavity of a microphone enclosure. The ear models may be protected against physical damage by end grills. A circuit board, microphone cable interface, power indicator, power switch and batteries may be located in the lower shell of the enclosure. A handle may serve as the hand grip for the microphone as well as a battery cover.

23 Claims, 6 Drawing Sheets

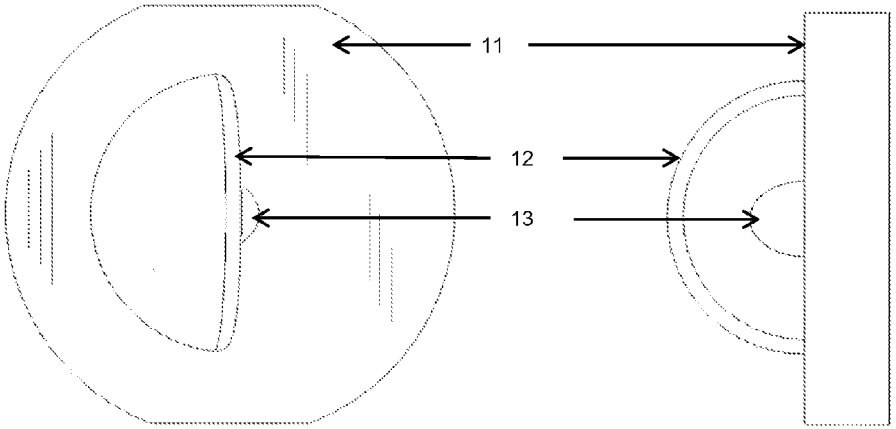
Fig 3.
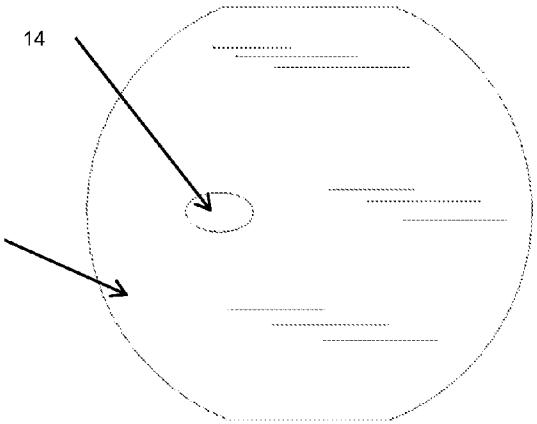
Fig 4.
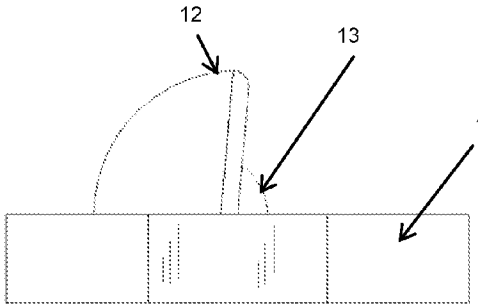
Fig 5.
Fig 6.

EAR MODELS WITH MICROPHONES FOR PSYCHOACOUSTIC IMAGERY

CROSS REFERENCE TO RELATED APPLICATIONS

The present application claims the benefit of the filing date of U.S. Provisional Patent Application Ser. No. 61/425,674, filed Dec. 21, 2010. The foregoing application is incorporated by reference in its entirety as if fully set forth herein.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to microphones and sound reproduction, and more particularly to an improved microphone apparatus for psychoacoustic imagery.

BACKGROUND INFORMATION AND DISCUSSION OF RELATED ART

The human ear pinna (the visible external structure of the ear) and the ear canal modify sound waves before they reach the ear drum. This is known as the pinna notch effect and plays a major role in psychoacoustics. The human brain processes the sound phase and pinna notch difference between the left and right ears and creates the perception of sound localization so that we can feel the location and the distance of the sound source relative to our head in three dimensional space. This is a well-researched science, and there exists known binaural microphone technology which uses a dummy ear replica or human head worn microphone to attempt to capture the psychoacoustic sound we experience in our normal hearing.

For example, U.S. Pat. No. 4,088,849 to Usami, et al. discloses a headphone unit incorporating microphones for binaural recording including a headphone having a pair of microphone-loudspeaker units interconnected by a clamping strap for holding the units against the ears of a wearer. The loudspeaker and a microphone of each unit are isolated acoustically from each other by an enclosure. The enclosure is formed with a generally semicylindrical surfaced portion to simulate the human earlap and a flat surface normal to the semicylindrical surface. The microphone is mounted on the flat surface with its main direction of acoustic sensitivity oriented to a dummy earlap to receive a sound wave reflected therefrom.

U.S. Pat. No. 4,308,426 to Kikuchi describes a dummy head for use in recording binaural sounds and includes a pick-up for the sounds in the form of two microphones. The head comprises a pair of simulated ears, each having a single smooth three-dimensional, curved surface extending radially in all directions so the inner surface of an auditory canal is continuous with the curved surface and the junction area between them is smoothly curved, to improve the frequency characteristics of the output signals of the microphones. The microphone is located in each ear.

U.S. Pat. No. 7,715,568 to Nakano teaches a binaural sound reproduction apparatus including a correction filter operable to filter an input sound signal that is recorded using a binaural recording microphone and to supply the filtered signal to a headphone, an adaptive filter to which the input sound signal is supplied, and a difference detector determining a difference between a sound signal that is obtained by collecting a sound reproduced by the headphone using a sound-collecting microphone that is the same as the binaural recording microphone, or that has a similar characteristic to that of the binaural recording microphone, and a sound signal output from the adaptive filter, and for transmitting the difference to the adaptive filter. The adaptive filter determines the inverse of a synthesis characteristic from the headphone to the sound-collecting microphone based on the input sound signal and the difference, and sets the determined characteristic as a characteristic of the correction filter.

United States Patent Application 20080002948 to Murata, et al. discloses a video-audio recording and reproducing apparatus with a built-in stereo microphone and an external microphone connection terminal. The external microphone connection terminal is connected to a binaural microphone to be attached to the ears of a photographer. When the binaural microphone is used to collect ambient sounds, an audio signal to be recorded on a recording medium is switched from an audio signal from the built-in stereo microphone to a binaural audio signal from the binaural microphone. The photographer puts the binaural microphone on his or her ears and collects ambient sounds around the photographer including a sound emanating from an object. The object is photographed with a camera unit. The recording medium records the binaural audio signal, a photographed video signal, and a binaural flag signal.

United States Patent Application 20090022343 to Van Schaack, et al. describes a pen based computing system that concurrently captures handwriting gestures and records audio using binaural recording. A binaural headset communicatively coupled to the smart pen device uses at least two microphones. A left microphone is placed in or near the left ear and the right microphone is placed in or near the right ear, each facing outward. Speakers are integrated into a shared housing with the microphones facing inward towards the ear canal to play back the audio recordings. By recording audio with microphones placed close to the ears, the system provides realistic sounding playback and allows users to more easily differentiate between multiple sources of audio.

United States Patent Application 20100104118 to Sasidharan, et al. teaches methods and systems of earpiece based binaural sound capturing and playback. In one embodiment, a method for recording and playback of a binaural sound includes receiving a record command for a binaural sound, and recording electrical data which correspond to the binaural sound captured through an associated binaural sound capturing system. Further, the associated binaural sound capturing system includes two earpieces for a right ear and a left ear for a user. Each of the two earpieces includes a housing and a speaker embedded in the housing facing an inner ear of the user. In addition, the each of the two ear pieces also includes a microphone embedded in the housing at an ear canal of the user for converting the binaural sound received by the ear canal to the electrical data. Furthermore, the method includes playing back the electrical data in response to a playback command.

The foregoing patents and patent applications reflect the current state of the art of which the present inventor is aware. Reference to, and discussion of, these patents and applications is intended to aid in discharging Applicant's acknowledged duty of candor in disclosing information that may be relevant to the examination of claims to the present invention.

However, it is respectfully submitted that none of the above-indicated patents or applications disclose, teach, suggest, show, or otherwise render obvious, either singly or when considered in combination, the invention described and claimed herein.

SUMMARY OF THE INVENTION

The present invention provides a compact portable stereo microphone apparatus that can acquire three dimensional immersive sounds which can then be recorded and played back in a standard audio recording device. The apparatus preferably includes two elastomer fabricated simplified human ear elements (ear models) fitted at the ends of a cylindrical cavity of a microphone enclosure. The ear models may be protected against physical damage by end grills. A circuit board, microphone cable interface, power indicator, power switch and batteries may be located in the lower shell of the enclosure. A handle may serve as the hand grip for the microphone as well as a battery cover.

The microphone apparatus is preferably constructed as a housing having a pair of ends, each end bearing an ear model comprising a base portion having an outer surface, and a canal portion having an opening on the outer surface and extending from the outer surface into the base portion. A first reflector portion is located on the base portion outer surface at least some distance from the canal portion opening and defines a cavity with a first acoustically reflective surface. A second reflector portion is located on the base portion outer surface substantially facing the first reflector portion cavity and has a second acoustically reflective surface. A microphone is positioned adjacent the canal portion, such that the first reflector reflects ambient sound towards the second reflector, and the second reflector reflects sound from the first reflector into the canal opening and to the microphone.

It is therefore an object of the present invention to provide a new and improved compact portable stereo microphone apparatus that can acquire three dimensional immersive sounds which can be recorded and played back in a standard audio recording device.

It is another object of the present invention to provide a new and improved microphone apparatus for psychoacoustic imagery.

A further object or feature of the present invention is a new and improved microphone apparatus for psychoacoustic imagery that models the pinna notch effect of the human ear but does not resemble a human ear in shape or size.

An even further object of the present invention is to provide a novel microphone apparatus for psychoacoustic imagery that does not require a sound absorbing baffle or dummy head to be placed between the microphones.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front view of an ear model portion of the microphone apparatus;

FIG. 4 is a side view thereof;

FIG. 5 is a top view thereof;

FIG. 6 is a back view thereof;

DETAILED DESCRIPTION OF THE INVENTION

Figure 1:
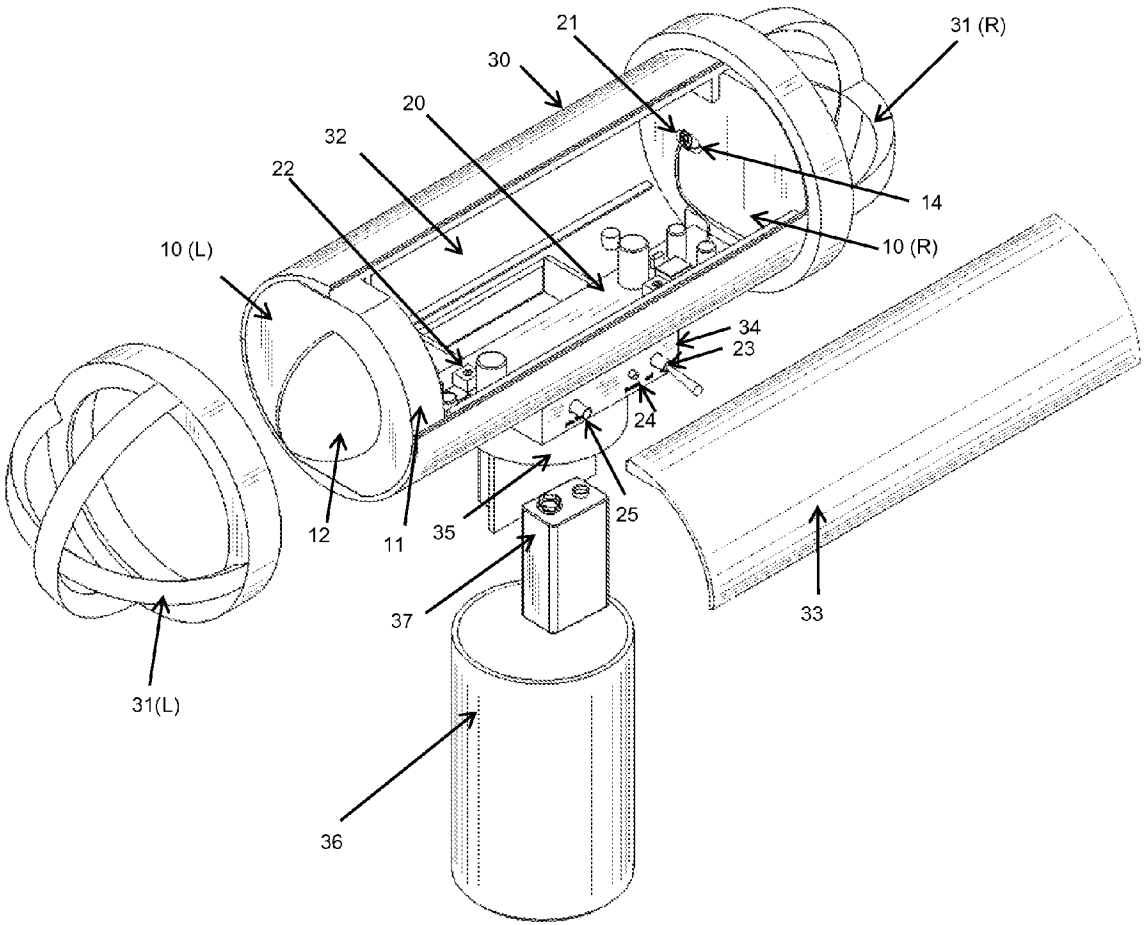
FIG. 1 is an exploded rear perspective view of a microphone apparatus of this invention.
Figure 2:
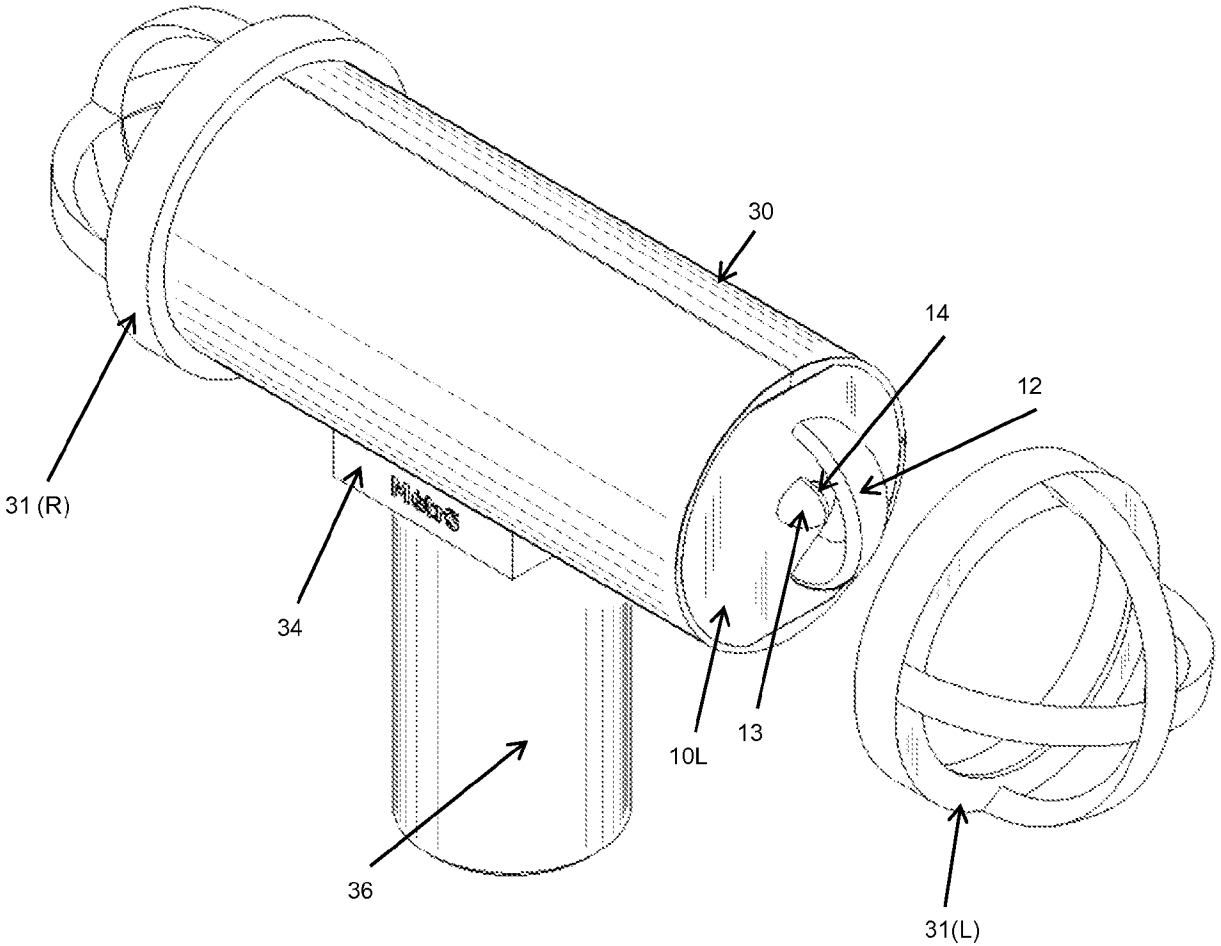
FIG. 2 is a front perspective view thereof.

Referring to FIGS. 1 through 10, wherein like reference numerals refer to like components in the various views, there is illustrated therein a new and improved microphone apparatus for psychoacoustic imagery.

FIGS. 1-10 illustrate a first preferred embodiment of the microphone apparatus of this invention. In FIG. 1, the top cover 33 is opened to show the low noise pre-amplifier circuit board 20. Left end grill 31(L) is removed to show the left ear model 10(L) fitted inside the enclosure cavity 32. The handle 36 is removed to show the batteries 37 in the battery compartment 34.

The simplified human ear model 10 is a short cylindrical structure with a slanted microphone canal 14 bored through the elastomeric base 11. There are two concave appendages attached to the elastomeric base 11 and they are referred to as major reflector 12 and minor reflector 13.

The ear model emulates the function of the human ear pinna and ear canal. The major reflector 12 selectively accentuates and attenuates sound depending on its direction by reflecting or blocking the sound entering the microphone canal 14. Minor reflector 13 also helps in reflecting sounds into the microphone canal 14. Both the reflectors function very much like the concha and tragus of the human ear to produce the "pinna notch" effect and add to the psychoacoustic spatial information in the recorded sound. The ear model is placed within a protective cylindrical cavity 32 of the enclosure 30 and is further protected by end grills 31.

The ear model is smaller in dimension than a mature human ear while producing the pinna notch effect to facilitate psychoacoustic recording. The small size of the ear model allows it to be incorporated within a low profile microphone cabinet or embedded within other devices like a handheld computer, camera, robot etc.

The ear model has been modeled after three most influential sound reflecting and modifying anatomical structure of the human ear: 1) the ear canal, 2) concha, and 3) tragus. These three anatomical parts are modeled by three key contours of the ear model: the microphone canal 14, major reflector 12, and minor reflector 13, respectively.

Figures 7, 8:
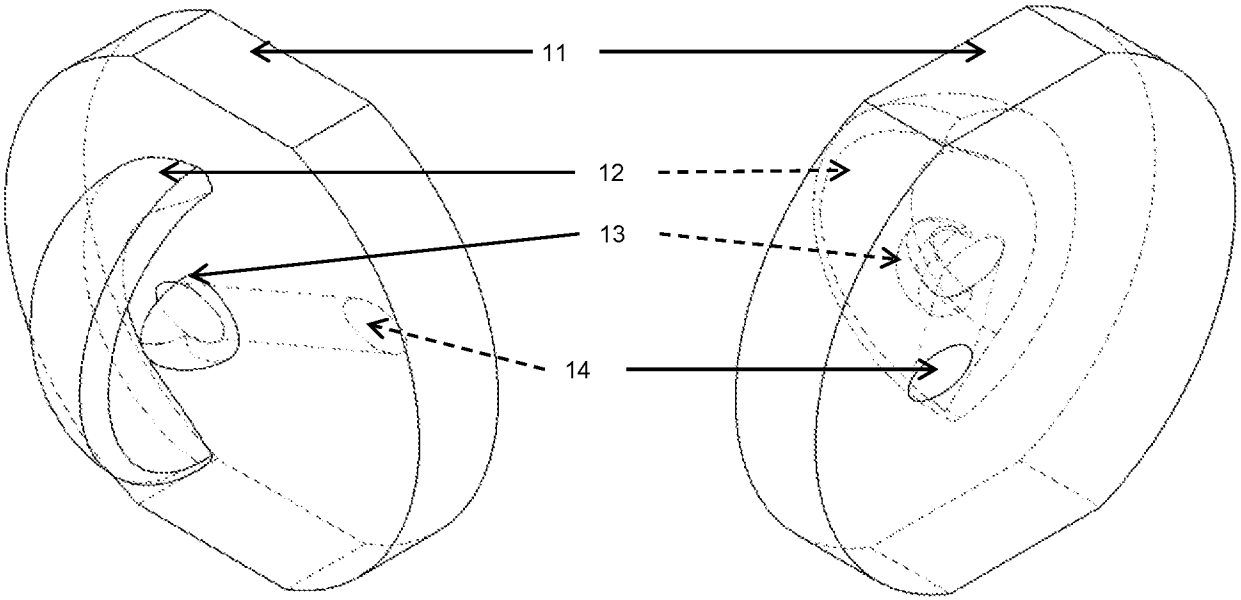
FIG. 7 is a front perspective view thereof, with hidden surfaces shown as dotted lines.
FIG. 8 is a rear perspective view thereof.
Figure 9:
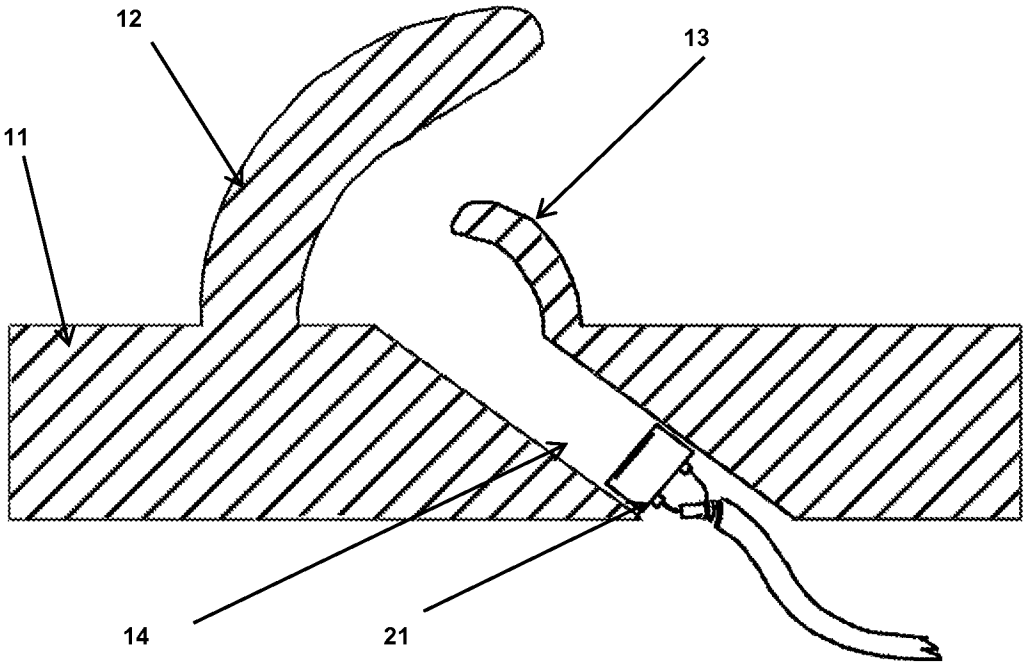
FIG. 9 is a cross sectional view of an ear model portion, illustrating a microphone placed in the microphone canal.
Figure 10:
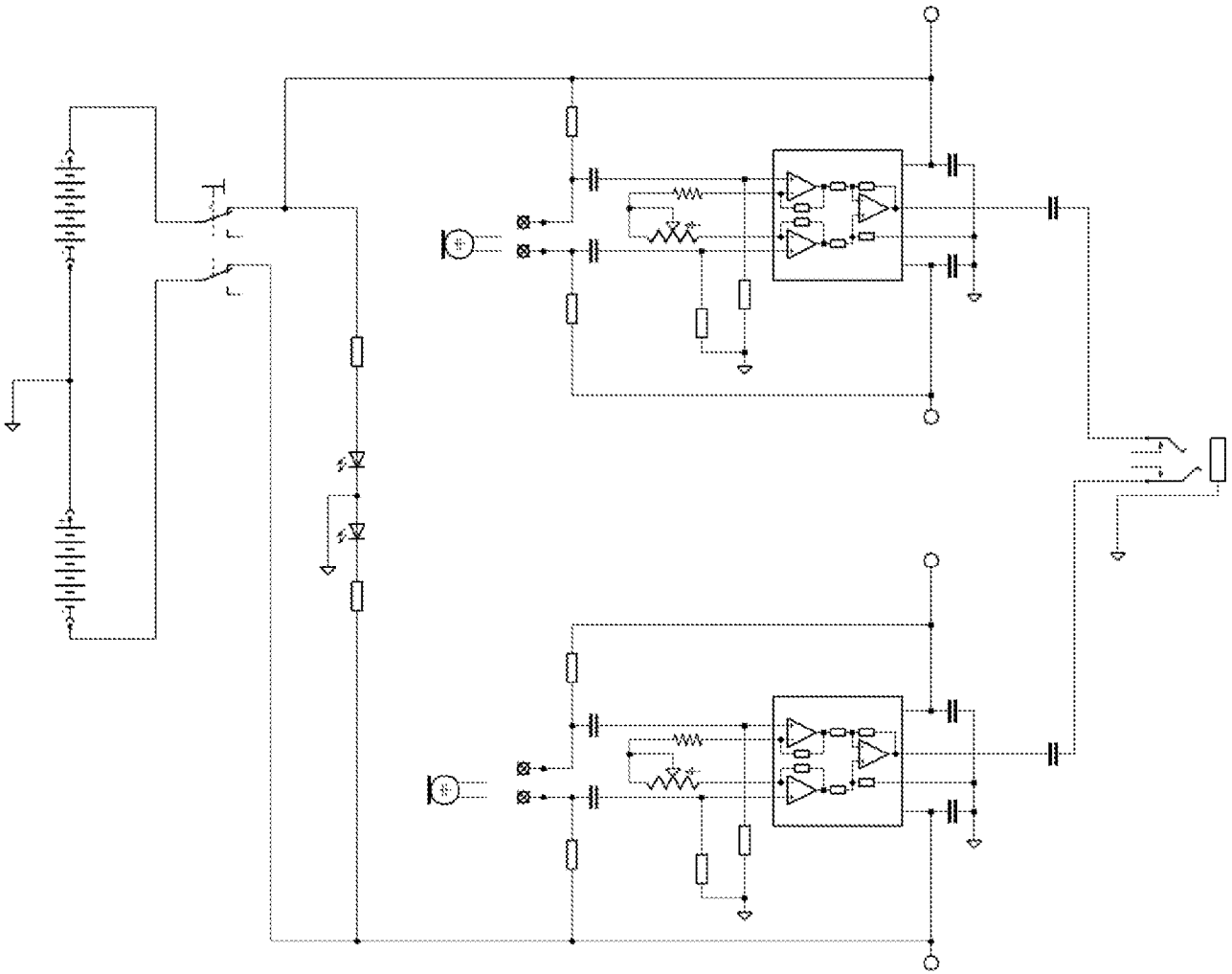
FIG. 10 is a schematic block diagram of a low noise preamplifier for a microphone apparatus of this invention.

The microphone canal is bored at a slanted angle in the ear model base 11. The major and minor reflectors are two curved projections on the ear model base, facing each other as shown in FIG. 7. The minor reflector 12 is placed at the rim of the microphone canal 14. The major reflector 13 is placed opposite to the minor reflector and away from the rim of the microphone canal (e.g., 50 to 200 mm).

The curvatures of the major and minor reflectors are non-critical as there are infinite variations of human ear shape and size. No two human ears have the same exact pinna size or produce the exact same pinna notch effect. Therefore, it is possible to reduce the scale of the ear model, and change the base shape or major and minor reflector shape and curvature while still achieving the simulated pinna notch effect in the microphone canal 14. The requirements to construct an effective ear model are to satisfy the following rules:

The ear model should be constructed out of an elastomeric compound, which has feel and consistency close to human skin. The elastomer used for the ear models should have a sound reflection coefficient similar to the human ear, e.g., about 0.25 at 125 Hz, 0.45 at 500 Hz, and 0.5 at 1 KHz and higher. The microphone canal should be bored at an angle in the base of the ear model. The microphone should be placed at the end of the microphone canal. A small slightly curved sound reflecting projection (minor reflector) should be constructed at the rim of the microphone canal. A larger slightly curved sound reflecting projection (major reflector) should be constructed on the other side of the microphone canal and facing the minor reflector. Finally, there should be some distance between the base of major reflector and the rim of the microphone canal.

The low noise pre-amplifier circuit is a printed circuit board 20. For each microphone channel, there is a gain adjustment preset 22 which is used to calibrate the gain balance of the two pre-amplifier channels. The circuit board is powered by battery 37 through power switch 23. Microphones 21 are placed in the microphone cavity of the ear model and connected to the circuit board by using shielded wire.

The microphone low noise pre-amplifier is constructed from ultra-low noise high fidelity instrumentation operational amplifiers placed in proximity to the microphones to ensure utmost fidelity of the sound. The pre-amplifier for each channel is equipped with a gain control preset to fine calibrate and balance the gain of the left and right channels.

The enclosure is preferably an elongated structure capable of housing two ear models approximately 200 centimeters apart to obtain the necessary stereo phase difference. It should also be able to house the circuit board and batteries. The enclosure provides safe housing of the ear models, microphone, the electronic circuit board and battery from the elements of nature. It is also aesthetically pleasing and provides a handle to grip and a tripod screw socket to mount on a camera tripod, microphone boom pole or other support system.

The enclosure has a monocoque design. It is an elongated cylindrical cavity 32 to house the ear models 10 and circuit board 20. The ear models are protected by two screwed in end grills 31 which also hold the top cover 33 together with the enclosure cavity 32. There is an interface box 34 at the midpoint of the cylindrical cavity 34. The battery compartment 35 is below the interface box. The handle 36 screws on the top of the battery compartment 35. The enclosure of the microphone has no direct bearing on the quality of the sound, so it can be designed to suit various applications and aesthetics.

In a normal dummy head microphone design, a dummy head is used to create the "head shadow" transfer function which effectively recreates the interaural level difference and interaural time difference in the recording. In the inventive design, the preferred cylindrical shape of the cabinet recreates the "head related transfer function" (HRTF) without requiring a full fledged human dummy head.

The microphone is assembled by mounting the circuit board 20 in the enclosure cavity 32. Two ear models 10 are placed in the enclosure cavity and microphones 21 are placed at the microphone canal 14 of the ear models 10. Top shell 33 is put into its place and secured by screwing in the end grills 31. The batteries are installed in the battery compartments 35 and handle 36 is screwed over the battery compartment 35. The handle 60 is screwed on the mounting screw thread 45.

To operate, the user first activates the microphone circuit 20 by manipulating the power switch 23 into a closed state. The power indicator 24 will glow to indicate the microphone is ready to operate. The user then connects an audio/video recording device to the microphone output socket using a suitable connecting cable, and places the microphone in a suitable position to receive sound from the sound source. Turn on the recorder to record the sound.

There are various alternative embodiments of the invention. For example, a low profile table top microphone enclosure can be designed to house the invention to convert it into a tele/video conference microphone. Using a miniature ear model and a suitable cabinet, the microphone can be clipped on to a laptop, tablet or handheld computing device. The output of the microphone can be connected to the microphone input of the computing device. A single channel ear model equipped microphone cabinet can be designed for creating a microphone array to record 5.1 or 7.1 surround sound.

The inventive apparatus can thus be characterized as a microphone apparatus constructed as a housing having a pair of ends, each end bearing an ear model comprising a base portion having an outer surface, a canal portion having an opening on the outer surface and extending from the outer surface into the base portion. A first reflector portion is located on the base portion outer surface at least some distance from the canal portion opening and defines a cavity with a first acoustically reflective surface. A second reflector portion is located on the base portion outer surface substantially facing the first reflector portion cavity and has a second acoustically reflective surface. A microphone is positioned adjacent the canal portion, such that the first reflector reflects ambient sound towards the second reflector, and the second reflector reflects sound from the first reflector into the canal opening and to the microphone.

The second reflector portion is preferably located on the base portion outer surface adjacent the canal portion opening, and substantially within the first reflector portion cavity. The housing ends preferably include a protective grill over the ear models. The canal portion is preferably inclined relative to the base portion outer surface, and has an alignment, such that the first reflector portion acoustically reflective surface has a focus substantially oriented towards the canal portion alignment. Preferably, the canal portion extends into the base portion at an angle between 45-60 degrees.

The first reflector portion can be symmetrical or asymmetrical. Similarly, the second reflector portion can be symmetrical or asymmetrical. The ear model base portion preferably has a diameter of between 1.5 to 4 inches, and the housing preferably has a width of approximately 200 cm +/− between the ends.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A microphone apparatus for psychoacoustic imagery, said apparatus comprising:

a housing having a pair of ends, each end bearing an ear model comprising a base portion having an outer surface, a canal portion having an opening on said outer surface and extending from said outer surface into said base portion, a first reflector portion located on said base portion outer surface at least some distance from said canal portion opening and defining a cavity with a first acoustically reflective surface, a second reflector portion located on said base portion outer surface substantially facing said first reflector portion cavity and located substantially within said first reflector portion cavity, and having a second acoustically reflective surface, and a microphone positioned adjacent said canal portion, wherein said first reflector reflects ambient sound towards said second reflector, and said second reflector reflects sound from said first reflector into said canal opening and to said microphone.

2. The microphone apparatus of claim 1 wherein said second reflector portion is located on said base portion outer surface adjacent said canal portion opening.

3. The microphone apparatus of claim 1 wherein said housing ends include a protective grill over said ear models.

4. The microphone apparatus of claim 1 wherein said canal portion is inclined relative to said base portion outer surface.

5. The microphone apparatus of claim 4 wherein said canal portion has an alignment, and said first reflector portion first acoustically reflective surface has a focus substantially oriented towards said canal portion alignment.

6. The microphone apparatus of claim 1 wherein said canal portion extends into said base portion at an angle between 45-60 degrees.

7. The microphone apparatus of claim 1 wherein said first reflector portion is symmetrical.

8. The microphone apparatus of claim 1 wherein said first reflector portion is asymmetrical.

9. The microphone apparatus of claim 1 wherein said second reflector portion is symmetrical.

10. The microphone apparatus of claim 1 wherein said second reflector portion is asymmetrical.

11. The microphone apparatus of claim 1 wherein said ear model base portion has a diameter of between 1.5 to 4 inches.

12. The microphone apparatus of claim 1 wherein said housing has a width of approximately 200 cm between said ends.

13. The microphone apparatus of claim 1 wherein said ear model is constructed from elastomeric material having a sound reflection coefficient substantially similar to a human ear.

14. The microphone apparatus of claim 1 wherein said canal portion has a terminus, and said microphone is located at said terminus.

15. The microphone apparatus of claim 1 wherein said first reflector portion is located on said base portion outer surface from 50 to 200 mm from said canal portion opening.

16. The microphone apparatus of claim 1 wherein said housing includes a handle portion.

17. The microphone apparatus of claim 16 wherein said handle includes a battery.

18. The microphone apparatus of claim 1 wherein said housing includes a preamplifier circuit.

19. The microphone apparatus of claim 1 wherein said housing is substantially cylindrical in shape.

20. A microphone apparatus for psychoacoustic imagery, said apparatus comprising:

a housing having a pair of ends, each end bearing an ear model comprising a base portion having an outer surface, a canal portion having an opening on said outer surface and extending from said outer surface into said base portion, a first reflector portion located on said base portion outer surface at least some distance from said canal portion opening and defining a cavity with a first acoustically reflective surface, wherein said first reflector portion is symmetrical, a second reflector portion located on said base portion outer surface substantially facing said first reflector portion cavity and having a second acoustically reflective surface, and a microphone positioned adjacent said canal portion, wherein said first reflector reflects ambient sound towards said second reflector, and said second reflector reflects sound from said first reflector into said canal opening and to said microphone.

21. A microphone apparatus for psychoacoustic imagery, said apparatus comprising:

a housing having a pair of ends, each end bearing an ear model comprising a base portion having an outer surface, a canal portion having an opening on said outer surface and extending from said outer surface into said base portion, a first reflector portion located on said base portion outer surface at least some distance from said canal portion opening and defining a cavity with a first acoustically reflective surface, a second reflector portion located on said base portion outer surface substantially facing said first reflector portion cavity and having a second acoustically reflective surface, wherein said second reflector portion is symmetrical, and a microphone positioned adjacent said canal portion, wherein said first reflector reflects ambient sound towards said second reflector, and said second reflector reflects sound from said first reflector into said canal opening and to said microphone.

22. A microphone apparatus for psychoacoustic imagery, said apparatus comprising:

a housing having a pair of ends, wherein said housing has a width of approximately 200 cm between said ends, each end bearing an ear model comprising a base portion having an outer surface, a canal portion having an opening on said outer surface and extending from said outer surface into said base portion, a first reflector portion located on said base portion outer surface at least some distance from said canal portion opening and defining a cavity with a first acoustically reflective surface, a second reflector portion located on said base portion outer surface substantially facing said first reflector portion cavity and having a second acoustically reflective surface, and a microphone positioned adjacent said canal portion, wherein said first reflector reflects ambient sound towards said second reflector, and said second reflector reflects sound from said first reflector into said canal opening and to said microphone.

23. A microphone apparatus for psychoacoustic imagery, said apparatus comprising:

a housing having a pair of ends, each end bearing an ear model comprising a base portion having an outer surface, a canal portion having an opening on said outer surface and extending from said outer surface into said base portion, a first reflector portion located on said base portion outer surface from 50 to 200 mm from said canal portion opening and defining a cavity with a first acoustically reflective surface, a second reflector portion located on said base portion outer surface substantially facing said first reflector portion cavity and having a second acoustically reflective surface, and a microphone positioned adjacent said canal portion, wherein said first reflector reflects ambient sound towards said second reflector, and said second reflector reflects sound from said first reflector into said canal opening and to said microphone.

* * * * *